4/7/81 OR 4,259,976

United States Patent [19]

Gould

[11] 4,259,976

[45] Apr. 7, 1981

[54] METHOD FOR THE RECOVERY AND TRANSPORT OF THE CHEMICAL AND ENERGY VALUE OF LIGHT HYDROCARBONS

[75] Inventor: George D. Gould, Orinda, Calif.

[73] Assignee: Chevron Research Company, San Francisco, Calif.

[21] Appl. No.: 844,101

[22] Filed: Oct. 20, 1977

Related U.S. Application Data

[63] Continuation of Ser. No. 563,743, Mar. 3, 1975, abandoned, which is a continuation-in-part of Ser. No. 359,831, May 14, 1973, abandoned.

[51] Int. Cl.[3] ..... F17D 1/16

[52] U.S. Cl. ..... 137/13; 44/53; 44/51

[58] Field of Search ..... 137/13; 62/55; 302/66; 44/51, 53, 54, 80

[56] References Cited

U.S. PATENT DOCUMENTS

| | | | |
|---|---|---|---|
| 3,216,435 | 11/1965 | Poettman | 137/13 |
| 3,389,714 | 6/1968 | Hughes | 137/13 |
| 3,618,624 | 11/1971 | Vairogs | 137/13 |
| 3,670,752 | 6/1972 | Marsden | 137/13 |
| 3,730,201 | 5/1973 | Lefever | 62/55 X |
| 3,926,203 | 12/1975 | Marsden | 137/13 |

*Primary Examiner*—Alan Cohan

*Attorney, Agent, or Firm*—D. A. Newell; R. H. Davies; W. D. Reese

[57] ABSTRACT

Disclosed is an improved method for the recovery and transportation of the chemical and energy value of light hydrocarbons. Light, normally gaseous hydrocarbons are converted to methanol and mixed with a viscous hydrocarbon for transport in a pipeline.

11 Claims, No Drawings

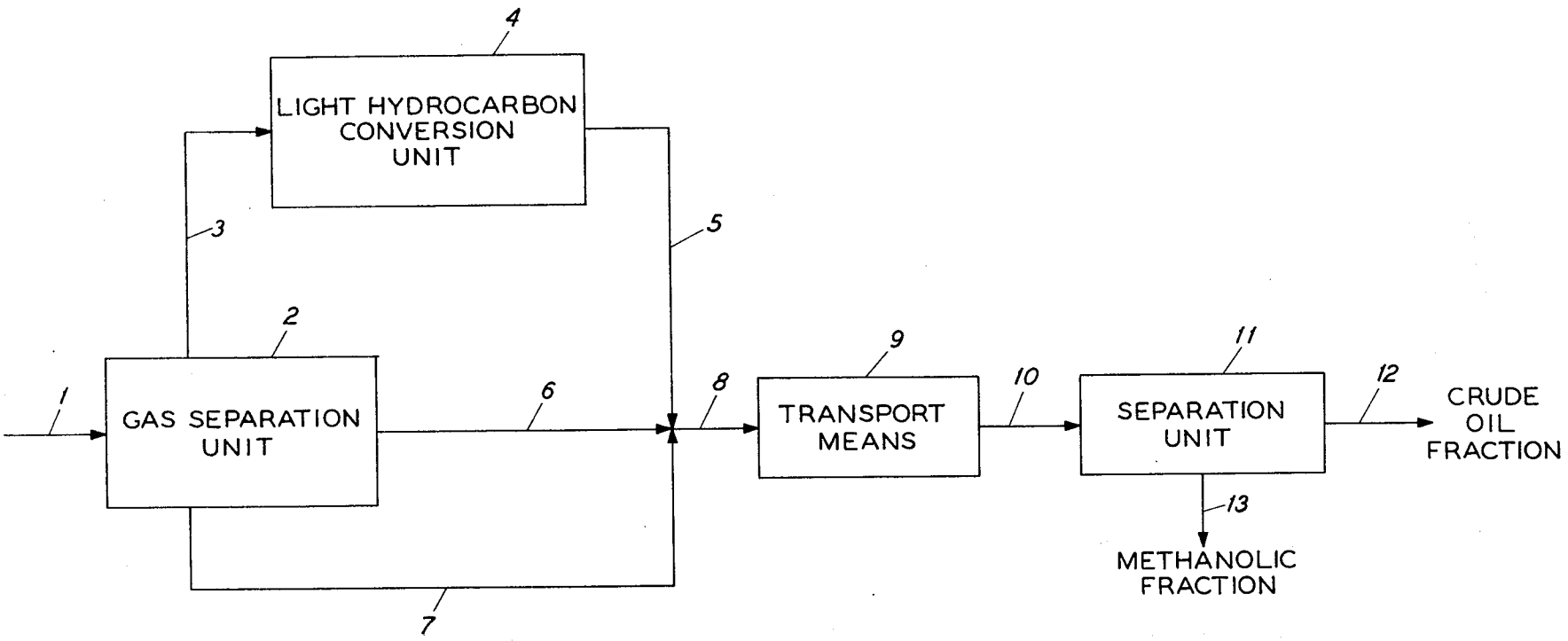
1
GAS SEPARATION UNIT
2
3
LIGHT HYDROCARBON CONVERSION UNIT
4
5
6
7
8
TRANSPORT MEANS
9
10
SEPARATION UNIT
11
12
CRUDE OIL FRACTION
13
METHANOLIC FRACTION

METHOD FOR THE RECOVERY AND TRANSPORT OF THE CHEMICAL AND ENERGY VALUE OF LIGHT HYDROCARBONS

CROSS-REFERENCE TO RELATED APPLICATION

This application is a continuation of Ser. No. 563,743, Mar. 3, 1975; and which is a continuation-in-part of copending application Ser. No. 359,831, filed May 14, 1973, both abandoned, the entire disclosure of which is incorporated herein by reference.

BACKGROUND OF THE INVENTION

1. Field of the Invention

This invention relates to an improved method for recovering and transporting the chemical and energy value of light normally gaseous hydrocarbons. More particularly, it relates to converting a low-molecular-weight (a light hydrocarbon) portion of petroleum to methanol and transporting a mixture of petroleum and methanol in a pipeline or tank ship to a new distant location.

2. Description of the Prior Art

For transport overland, light normally gaseous hydrocarbons have typically been transported in gas pipelines. Often, however, the cost of building a pipeline cannot be justified in relation to the quantity of gas to be transported. Petroleum is usually produced as a mixture of hydrocarbons including light normally gaseous hydrocarbons. The normally liquid portion of the crude petroleum usually is transported overland in a pipeline. Because of the high pressures involved, it is not practical to transport the light hydrocarbons along with the normally liquid hydrocarbons. If a separate pipeline for transport of the normally gaseous fraction is not available or can't be economically justified, then the light hydrocarbons are flared (burned) and the chemical and energy value of the light hydrocarbons is lost.

When the source of the crude and the marketplace are separated by an ocean and a pipeline cannot be built, then the typical means of transport of the normally liquid hydrocarbons has been by tanker. Various means for the recovery and transport of light hydrocarbons for transoceanic shipment are known in the art. For example, the July 12, 1972, *Chemical Engineering*, p. 35, compares the cost of shipping liquefied natural gas (LNG) via insulated and refrigerated tank ships with the cost of converting natural gas to methanol with shipment of the methanol per se in conventional tankers. The LNG option involves substantial energy consumption for compression to liquefy the gases and then for re-evaporation at the receiving terminal.

Also somewhat related to the present invention are prior art processes directed to improving the pipeline transport of crude oil. For example, in U.S. Pat. No. 3,216,435 Poettman teaches that small amounts of water, detergent solutions and other liquids may be added to a viscous oil being transported in a pipeline in order to reduce the pumping cost of the viscous liquid.

Similarly, in U.S. Pat. No. 2,821,205 Chilton et al teach minor amounts of water, up to 6 percent and preferably 0.5 to 1 percent, may be added to a viscous petroleum stream being pumped so that the water forms a lubricating film between the flowing petroleum and the inner wall of the pipeline.

Other methods for lowering crude oil viscosity for pipeline transport include the addition of a miscible gas, for example, carbon dioxide, as taught in U.S. Pat. No. 3,618,624.

The problems re efficient transport of the chemical and energy value of light hydrocarbons are also common to recovery of other viscous oil resources. For example:

(1) In the retorting of shale oil, much light gas product and a viscous oil (pour point typically about 90° F.) are produced;

(2) Similarly in the treatment of tar sands, much light gas product and a viscous oil are produced;

(3) And in the gasification of coal, much gas product and a viscous oil are produced.

In all of these alternate oil resources and for petroleum, as discussed above, there is a need for a practical method for the recovery and transport of the chemical and energy values of these light, normally gaseous hydrocarbons.

SUMMARY OF THE INVENTION

The object of this invention is to provide a means for the recovery and transport of the chemical and energy (fuel gas) value of light hydrocarbons.

The object of this invention is achieved by:

(1) converting the light hydrocarbon into methanol;

(2) mixing all or part of the methanol with a viscous oil;

(3) transporting the resulting mixture of methanol and oil in a pipeline (or tank ship) to a more desirable location; and (4) decanting the mixture into a separate oil fraction and a separate methanol fraction.

By a light hydrocarbon, as used herein, is meant a feed composed of at least one hydrocarbon having a boiling point in the range −184° C. (methane) and heavier hydrocarbons to about 150° C. (usual naphtha end point).

The principal advantage of the present invention resides in that separate pipelines for gas transport and crude transport are not necessary. A further advantage of the present invention resides in the fact that the methanol and crude can be separated at the terminal end of the pipeline by decantation, which is essentially an energy-free separation.

Representative light hydrocarbon feeds include methane, ethane, propane, butane, natural gas, naphtha, and hydrocarbon mixtures having a boiling point range (STP within the range −184° C. to 150° C.

By a viscous oil, as used herein, is meant one having a viscosity at 130° F., which is at least 3.0 centistokes.

Referring now to the drawing, crude oil from a producing well is delivered via line 1 to a gas separation unit 2. This unit may be a conventional gas-oil separator located either in the well or outside of the well. Where there is little or no natural gas in the crude oil, unit 2 may be a combination of one or more light hydrocarbon recovery units, including a separate gas well, a gas-oil separator, a visbreaker, and an atmospheric pressure still. Via line 3, separated gas and/or distilled light hydrocarbon is withdrawn from unit 2. Via line 7 excess distillate, if any, and/or excess distillate from the visbreaker or still is mixed with reduced-crude oil removed from unit 2 via line 6 by joining lines 7 and 6.

Unit 4 includes a synthesis gas ($H_2$, CO) producing facility (steam reforming or partial oxidation) and a methanol production facility. These are conventional facilities known and used in commercial practice. Via line 5 the crude methanol product stream is withdrawn from unit 4 and added to the reduced-crude oil by joining lines 5 and 6. (Lines 5, 6 and 7 may have a common confluence as shown or separate confluences.) The combined streams (5, 6 and 7) are line mixed in line 8 and passed to transport means 9.

Transport means 9 may be a segment of a pipeline and in such case 8, 9 and 10 are segments of a pipeline which delivers the methanolic crude oil mixture or pipeline charge to separation unit 11 at the terminus of the pipeline.

Separation unit 11 is a settling tank or holding unit wherein a separation of the mixture into two liquid phases takes place. Surprisingly, and although the specific gravities of methanol and crude oil are quite close, the phase separation, in general, takes place readily. This rapid phase separation of the methanol and crude provides an added energy savings in that the methanol and crude can be separated by decantation without the significant use or loss of energy as would be necessary, for example, if the mixture had to be separated using a distillation column. Should the difference in the specific gravities be so small that the separation is impracticably slow, it is but a simple matter to add a minor amount of water to the mixture. Usually the crude oil already contains natural water and this is extracted into the methanol during the transit of the methanolic mixture to the separation unit. Alternatively, the methanol may be separated from the oil in a simple fractionation stage. The separated crude oil is then used as a feed to a petroleum refinery. The methanol fraction may be used as is as a liquid fuel, may be converted to synthetic natural gas by ordinary means, or may be purified and used as a solvent, a precursor in a chemical process, and the like.

In an alternate embodiment, one which is preferred where a crude oil producing field and a gas field are reasonably contiguous, the light hydrocarbon feed for the present invention is obtained, in whole or part, from the gas field and the methanol produced is added to the crude oil from the oil field.

A viscous oil and a light hydrocarbon gas are produced in the treatment of oil shale or tar sands, and in the gasification of coal. In each case the advantages of the present invention may be enjoyed by the practice of the present invention and the application of the method herein is contemplated. The use of conventional methods of production of the respective gas and viscous oil are also contemplated.

I have found that a viscous oil and methanol, particularly methanol and crude oil, do not appear to form stable emulsions. When a mixture of these components is immobile, a prompt phase separation usually occurs. When the mixture is passed in concurrent flow through a pipeline and with the methanol present as a minor component of the flowing mass, there is a substantial reduction in the energy input required to maintain the flow. Thus, when the relative amount of methanol is sufficient, a thin methanolic film surrounds the crude oil, and is interposed between the moving mass of the crude oil and the metal of the pipe. The effective viscosity relative to the mass flow is substantially less. Consequently, the energy input (pump work) required for maintaining the flow is also less. Thus an added advantage of the present invention is that the energy required to pump the viscous oil only is substantially reduced by pumping the methanol-viscous oil mixture.

Another advantage of the present invention resides in the ability to pump the crude oil at a lower temperature relative to the oil per se. This is particularly advantageous where a permafrost region must be traversed by a pipeline as, for example, in Alaska. Thus, by pumping the methanol-viscous oil mixture in a single pipeline one can substantially reduce the construction costs of the pipeline by eliminating or at least reducing the need for insulating the pipeline to prevent melting of the permafrost.

Another advantage of the present invention resides in the elimination or reduction of an icing problem in a crude pipeline. Crude oil normally contains small amounts of oil and the formation of ice can cause severe pumping problems when pumping crude per se. This icing problem is substantially reduced or eliminated in the present invention since the water is extracted by the methanol and the methanol-water mixture does not freeze at normal transport temperatures.

The amount of methanol relative to the viscous oil which may be included in the pipeline charge can vary over a wide range, for example, from about 0.2 to 50 volume percent of the mixture may be methanol. Preferably, however, in order to avoid the need for building a second pipeline for gaseous hydrocarbons, all of the light hydrocarbons produced with the viscous crude will be converted to methanol and transported along with the viscous oil. Typically under these preferred conditions from greater than 6 to about 30 volume percent of the mixture will be methanol.

No particular method is necessary for the introduction of the viscous oil-methanol charge into the pipeline. During the flow of a suitable charge through a pipeline, the methanol in general becomes distributed around the periphery of the flowing charge. Preferably, and in order to more promptly enjoy the added advantage of the invention of reduced pumping costs, the methanol is introduced into the pipeline at a peripheral site, for example, via a circular in-line injection manifold or one or more nozzles located on the inner circumference of the pipe. The desired relative amounts of the oil and methanol are charged to the pipeline by conventional metering and pump control means.

Where the oil component is especially viscous and some increase over the ambient temperature is required for the oil, no particular problem is encountered in the present method. Conventional means may be used, for example, gas or oil-fired heaters and the like, to heat the oil. In addition, since the methanol is produced at an elevated temperature, the hot freshly produced and unpurified methanol product may be directly introduced as a charge. Other and ordinary means of heat conservation, the use of indirect heat exchangers and the like, are also contemplated for use herein.

The light hydrocarbon conversion unit herein comprises a synthesis gas (CO plus $H_2$) production component and a methanol production component. These are conventional and of themselves are known. In the present context, however, their employment is advantageous and unique. In the synthesis gas component steam and a lower hydrocarbon feed are reacted as summarized by the representative equations for the primary reaction:

$$C_nH_{2n+2}+nH_2O \rightarrow nCO+(2m+1)H_2, \text{ e.g., methane steam;} \quad (1)$$

$$CH_4+H_2O \rightarrow CO+3\,H_2; \quad (2)$$

or the synthesis gas is produced by a partial oxidation using molecular oxygen gas:

$$C_nH_{2n+2} + n/2\ O_2 \rightarrow nCO + (n+1)H_2. \quad (3)$$

In the methanol production component the primary reaction is summarized;

$$CO + 2H_2 \rightarrow CH_3OH. \quad (4)$$

Representative descriptions of synthesis gas producing processes as described in U.S. Patents include: U.S. Pat. Nos. 2,628,890; 3,106,457; 3,119,667; 3,132,010; 3,271,325; 3,417,029; and 3,433,609. The article, "Steam Naphtha Reforming By the ICI Process," American Chemical Society, Division of Fuel Chem., Preprint 8(1), Pages 40–51 (1964), contains another description.

Representative partial oxidation processes useful herein as a source of synthesis gas include:

(1) the Shell Gasification Process, and (2) the Texaco Partial Oxidation Process.

Representative methanol production processes useful herein, as described in U.S. Patents, includes U.S. Pat. Nos. 3,326,956 and 3,501,516. Another representative process is the low pressure methanol synthesis process of the Imperial Chemical Industries (ICI) (see Hydrocarbon Processing, November 1970, Pages 183–186). Another description of methanol production facilities including synthesis gas production (steam reforming) is described in The Oil and Gas Journal, Jan. 10, 1972, pages 63–68.

It is preferred in the method of the present invention to generate synthesis gas by steam reforming natural gas and to use the resulting gas mixture comprising CO and $H_2$ as a feed for the production of methanol in an ICI Low Pressure Methanol Plant.

For the steam reforming, the natural gas feed is pretreated to remove sulfur compounds which are poisons to the reforming catalyst. A typical reforming catalyst is composed of nickel oxide composited with alumina and promoted with a minor amount of potassium oxide. A mixture of steam and the treated natural gas is contacted with the catalyst at a temperature in the range from about 1200° to 1700° F. and a pressure in the range from about 50 to 300 psig. The pressure of the resulting synthesis gas is conveniently and preferably raised to a satisfactory level for methanol production by means of a centrifugal compressor.

The methanol synthesis step is preferably carried out at a relatively low pressure, i.e., a reaction zone pressure below about 1500 psig. Many methanol synthesis plants operate at a pressure of about 4000 to 5000 psig; although they are now in operation one or more methanol synthesis plants with a reaction zone pressure below about 1500 psig. Preferred catalysts for use in the low pressure methanol synthesis are copper oxide catalysts mixed with other metal oxides as promoters. The catalyst is made by precipitating the metal oxides from nitrate salts in a sodium carbonate solution as described in U.S. Pat. No. 3,326,956.

Although various embodiments of the invention have been described, it is to be understood that they are meant to be illustrative only and not limiting. Certain features may be changed without departing from the spirit or scope of the invention. It is apparent that the present invention has broad application for the transportation of crude oil and methanol mixtures. Accordingly, the invention is not to be construed as limited to the specific embodiments or examples discussed, but only as defined in the appended claims.

What is claimed is:

1. A method for recovering and transporting the chemical and energy value of light hydrocarbons, which comprises:

(a) producing methanol from said light hydrocarbons;

(b) mixing all or part of said methanol with a viscous hydrocarbon oil; and (c) transporting the resulting mixture of methanol and oil in a pipeline.

2. The method as in claim 1 wherein said oil is selected from the group consisting of crude oil, tar sand oil, shale oil and coal gasification oil.

3. The method as in claim 1 wherein said resulting mixture contains more than 6 volume methanol.

4. The method as in claim 1 wherein said resulting mixture contains an amount of methanol in the range from above 6 to 30 volume percent.

5. The method as in claim 1 wherein said transported mixture is separated into an oil fraction and a methanol fraction, said separation being effected by a means selected from the group consisting of decantation and fractional distillation.

6. The method for recovering and transporting the chemical and energy value of light hydrocarbons, which comprises:

(a) separating a light hydrocarbon fraction from an oil fraction;

(b) converting at least a portion of said light hydrocarbon fraction to methanol;

(c) adding at least a portion of said methanol to the remainder of said oil;

(d) transporting the resulting mixture of methanol and oil in a pipeline, said mixture containing an amount of methanol in the range from above 6 to 30 volume percent; and (e) decanting the transported mixture into a separate oil fraction and a separate methanol fraction.

7. The method as in claim 1 wherein said oil is crude oil, said light hydrocarbon fraction is produced in a natural gas field, and said oil is produced in a field separate from said gas field.

8. A method for recovering and transporting the chemical and energy value of light hydrocarbons, which comprises:

(a) producing methanol from said light hydrocarbons;

(b) mixing all or part of said methanol with a viscous hydrocarbon oil; and (c) transporting the resulting mixture of methanol and oil in a tankship.

9. A process for the long-distance transport of fossil fuel material, in which a part of the fossil fuel material to be transported is converted into methanol before being transported, and is utilized as a transport medium in the fluid transport of the remainder of the material.

10. A process according to claim 9, in which the material is coal, and the part of the coal not converted into methanol is converted into liquid hydrocarbons which are mixed with the methanol prior to transport.

11. A process as claimed in claim 9 in which the fossil fuel material is fossil oil and natural gas and in which at least the natural gas is converted into methanol, which is mixed with the oil, and the oil-methanol mixture is separated into its components after being transported.

* * * * *